United States Patent [19]

Kondo et al.

[11] 4,250,807

[45] Feb. 17, 1981

[54] HIGH SPEED PRINTER WITH STAIN PREVENTING MEMBER BETWEEN ALTERNATELY SPACED HAMMERS

[75] Inventors: Hiroatsu Kondo, Zushi; Mineo Nozaki, Kawasaki; Toshiaki Ozawa; Osamu Asakura, both of Tokyo; Shigeru Okamura, Yokohama, all of Japan

[73] Assignees: Canon Kabushiki Kaisha; Denshi Kabushiki Kaisha, both of Tokyo, Japan

[21] Appl. No.: 923,731

[22] Filed: Jul. 11, 1978

[30] Foreign Application Priority Data

Jul. 11, 1977 [JP] Japan ..... 52/82730

[51] Int. Cl.[3] ..... B41J 9/12

[52] U.S. Cl. ..... 101/93.09; 101/93.48; 101/93.16

[58] Field of Search .... 101/93.09, 93.14, 93.29–93.34, 101/93.48, 110, 111, 93.16, 93.17, 93.23, 416 A, 420, 93.21; 400/247, 248, 154, 568

[56] References Cited

U.S. PATENT DOCUMENTS

| | | | |
|---|---|---|---|
| Re. 28,796 | 5/1973 | Shizodaira et al. | 101/93.31 |
| 3,332,343 | 7/1967 | Sims | 101/93.09 X |
| 3,677,452 | 7/1972 | Wallace | 400/568 X |
| 3,734,012 | 5/1973 | Huggins | 101/93.16 |
| 3,750,794 | 8/1973 | Griggs | 101/93.23 X |
| 3,797,387 | 3/1974 | Decker et al. | 101/93.09 |
| 3,805,696 | 4/1974 | Tsuji | 101/110 |
| 3,994,219 | 11/1976 | Yasuda et al. | 101/93.09 |
| 4,054,089 | 10/1977 | Okabe | 101/110 |
| 4,070,963 | 1/1978 | Weaver | 101/93.29 |
| 4,110,050 | 8/1978 | Wood et al. | 400/248 |

*Primary Examiner*—Edward M. Coven

*Attorney, Agent, or Firm*—Fitzpatrick, Cella, Harper & Scinto

[57] ABSTRACT

A printing apparatus has a motor, a character drum rotated by the rotational force of the motor, a printing paper feed mechanism operable by the rotational force of the motor, and a mechanism for shifting hammers and a stain preventing member integral with said mechanism and shiftable by the rotational force of the motor. The stain preventing member has shielded portions at every other column.

2 Claims, 8 Drawing Figures

1
3
10
P
21
11
103
101
102
105
104
91
92
8a
8b
7b
7c
7a
2c
2b
2a
2e
A
B
6a
3a
6b
4e
3c
3b
4a
4b
4c
4d
5c
5a
5b
22
2
2d
M

HIGH SPEED PRINTER WITH STAIN PREVENTING MEMBER BETWEEN ALTERNATELY SPACED HAMMERS

BACKGROUND OF THE INVENTION

1. Field of the Invention

This invention relates to a printing apparatus in which intermediate hammers and a stain preventing member can be shifted by a simple mechanism.

2. Description of the Prior Art

Generally, in an impact printer having a plurality of columns wherein a character drum is rotated and hammers are energized in synchronism with characters to be printed to thereby effect printing, the hammer mechanism directly driven by solenoids has required a great magnitude of electric power for the driving. Therefore, the power source has been of a greater capacity as the number of columns has been increased.

Further, when a plurality of columns is printed on a web of paper having a predetermined width, the column pitch becomes smaller and so, it has become difficult in terms of space to provide a hammer for each column.

Therefore, consideration has been given to a technique of decreasing the number of hammers to half by providing intermediate hammers between hammers and a character drum and shifting the intermediate hammers by one column pitch to enable printing of two columns by one hammer.

SUMMARY OF THE INVENTION

It is an object of the present invention to provide a printing apparatus having a mechanism for facilitating the shift of the intermediate hammers.

It is a further object of the present invention to provide a printing apparatus which is provided with a print stain preventing member shielded at every other column and shiftable with the intermediate hammer to thereby reduce the necessary printing energy and simplify the mechanism.

The invention will become more fully apparent from the following detailed description thereof taken in conjunction with the accompanying drawings.

DESCRIPTION OF THE PREFERRED EMBODIMENTS

Figure 1:
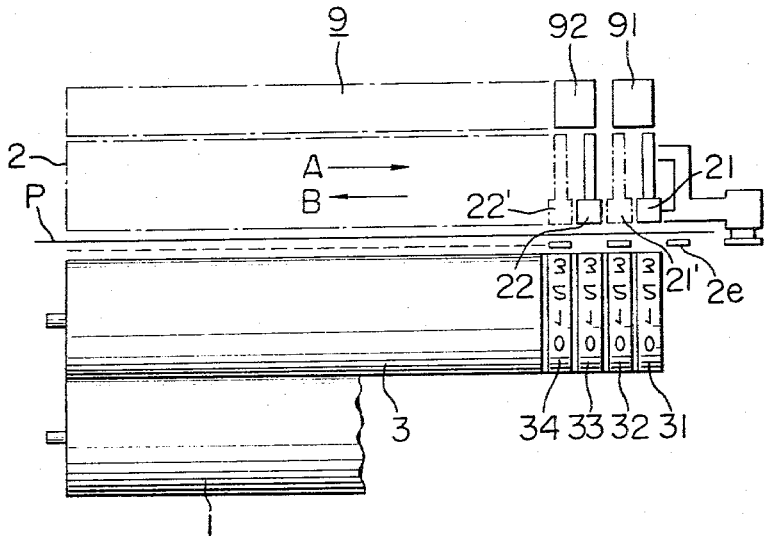
FIG. 1 is a plan view of an embodiment of a printing apparatus in accordance with the present invention.

FIG. 1 illustrates the printing principle of the present invention. Designated by 1 is an ink roller, 3 a character drum, P a web of printing paper, 2 a holder for an intermediate hammer group, 2e a stain preventing member shielded at every other column, and 9 a main hammer group. First, for setting up the initial condition, the printing paper P is fed and the holder 2 is shifted in the direction of arrow A.

Next, each of main hammer 91, 92, . . . is biased toward the character drum 3 to cause each intermediate hammer 21, 22, . . . to be projected when the characters on the rotating character drum have come to predetermined positions, and the characters on character wheels 31, 33, . . . on odd number columns of the character drum 3 are selected to effect printing on the printing paper. Under this condition, printing is effected at every other column. Then, an intermediate hammer, such as the intermediate hammer 21, is shifted to the position designated by 21 and the holder 2 is shifted in the direction of arrow B with every other stain preventing member 2e. Again by the bias of main hammers 91, 92, . . . , the columns neighboring the previously printed columns, namely, the even number columns 32, 34, . . . are printed. Next, the paper is fed again and the intermediate hammer holder 2 is again shifted in the direction of arrow A to return to its initial condition. In the above-described steps, a line of printing is effected.

Figures 2, 3, 4:
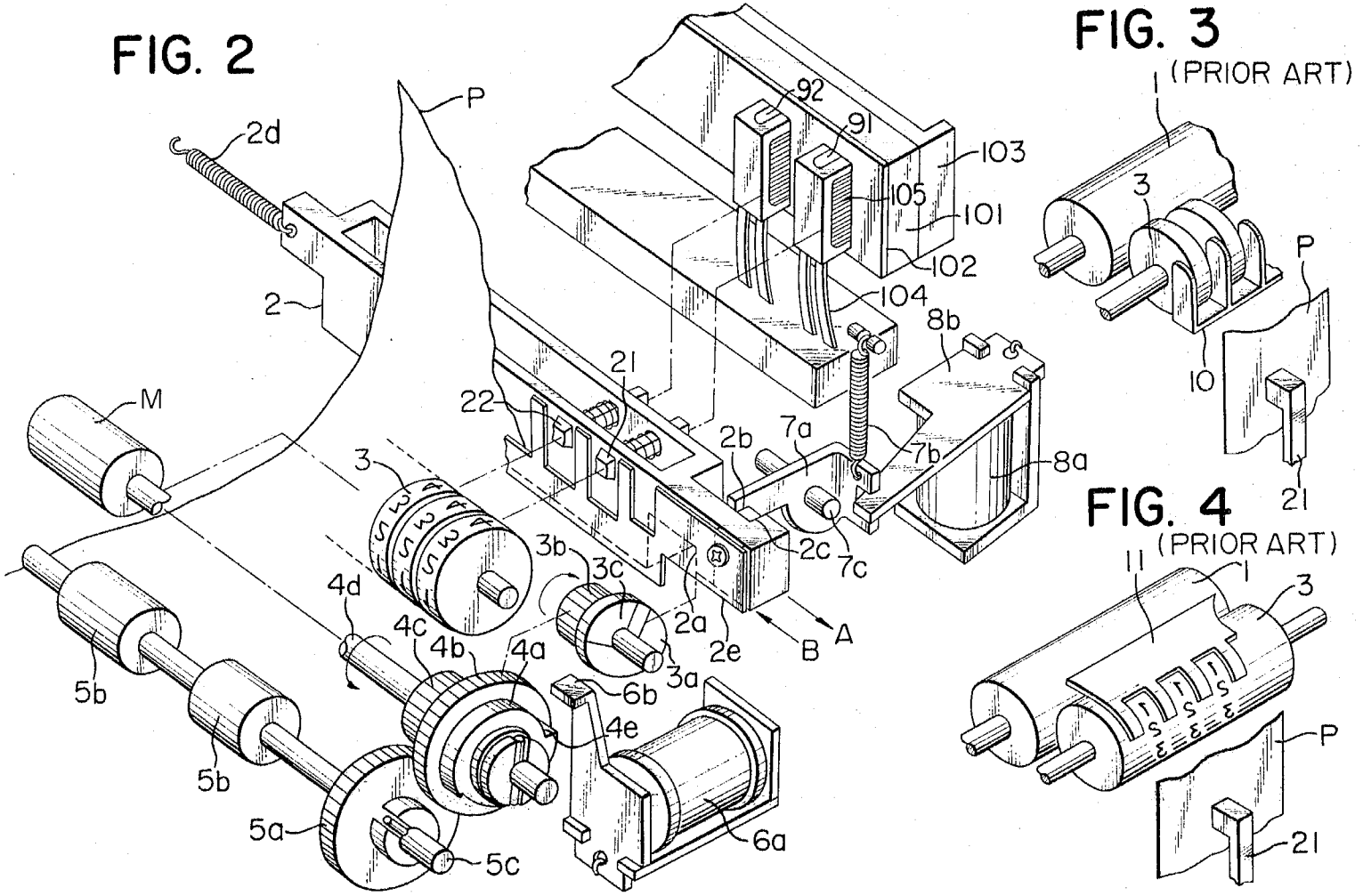
FIG. 3 (PRIOR ART)
FIG. 4 (PRIOR ART)
FIG. 2 is a schematic, exploded perspective view of the same embodiment.
FIGS. 3 and 4 illustrate the stain preventing member according to the prior art.

FIG. 2 shows a shifting mechanism for the hammer holder and the stain preventing member. Designated by 2d is a return spring of the holder 2, and 2e the stain preventing member shielded at every other column and mounted integrally with the holder 2. Designated by 3a is a shifting cam for the holder 2, 7a a positioning lever for the holder 2, and 4a a spring clutch for transmitting and disconnecting the rotation of a shaft 4d to gears 4b and 4c.

When electric power is supplied to the printer, a motor M is rotated to thereby start rotating the character drum 3 and the shaft 4d. Next, a paper feed solenoid 6a is energized to break the engagement of an armature 6b with a pawl 4e of the spring clutch 4a to permit a predetermined angle of rotation until the other pawl of the spring clutch 4a is engaged with the armature 6b. By way of the spring clutch 4a, the rotation of the shaft 4d is transmitted to the gears 4b and 4c, which in turn transmit the rotation to gears 5a and 3b engaged therewith. The gear 5a is secured to a shaft 5c, and rubber rollers 5b also secured to the shaft 5c feed the printing paper P. At the same time, by the rotation of the gear 3b, an end face cam 2a of the holder 2 engaged with the end face cam 3a is shifted in the direction of arrow A against the force of the spring 2d, by rotation of the gear 3b integral with an end face cam 3a. By the positioning lever 7a which tends to rotate counterclockwise about a shaft 7c by a spring 7b, the end face 2b of the holder 2 is held down so that the holder comes to a halt in the position as shown in FIG. 2.

In this operation, the holder 2 comes to its initial position to permit starting of the printing, and the main hammers 91, 92, . . . and the intermediate hammers 21, 22, . . . are energized by a printing signal as already described, so that odd number columns 31, 33, . . . are first printed as already noted. The main hammers 91, 92, . . . have iron cores and windings 105 provided in their hammer heads, and the iron cores are attracted to a permanent magnet 101 to bend springs 104. In this condition, when the windings 105 are electrically energized through the springs 104, there are created magnetic fields opposite to the magnetic field from the permanent magnet 101 so that the hammers are released to impact the intermediate hammers. Details of this operation are disclosed, for example, in U.S. Pat. No. 4,044,455.

When a shift solenoid 8a is energized, the armature 8b is attracted to rotate the positioning lever 7a clockwise about the shaft 7c to thereby release the positioning lever 7a from the end face 2b of the holder 2, and the holder 2 is shifted in the direction of arrow B by the spring 2d until an end face 2c one step above the end face 2b of the holder 2 is engaged with the lever 7a. At this time, the end face 2a of the holder 2 is stationary with a slight space left with respect to the bottom surface 3c of the cam 3a.

The intermediate hammers 21', 22', . . . are again energized in response to a printing signal to effect printing of even number columns 32, 34, . . . . When the printing has been completed, the paper feed solenoid 6a is again energized to feed the paper, which comes to a halt at the solid line position of the intermediate hammers 21, 22, . . . , thus restoring the initial position and waiting for the next cycle of printing. By this mechanism, the shift of the intermediate hammers is simply effected.

Description will now be made of the stain preventing member 2e shifted with the intermediate hammer holder 2.

In the conventional printing apparatus using an ink roller, the ink from the ink roller 1 is deposited on the type face of the character drum 3 as shown in FIGS. 3 and 4, so that unnecessary ink tends to be deposited onto other columnar portions because the paper P is caused to widely rock by the impaction of the hammers 21 during printing. To avoid this, the stain preventing members 10 and 11 are necessary and as shown, such stain preventing members have been inserted between all of the adjacent columns. As the result, in order for the ink on the character drum 3 to be transferred beyond the stain preventing members 10 and 11, the hammer 21 had to be intensely urged until the paper P comes into contact with the characters on the drum 3. This required much printing energy and necessarily involved creation of great noise. Also, the inconstant distance from the stain preventing members 10 and 11 to the surface of the drum 3 has resulted in variable printing density or sometimes incomplete printing in which a part of the characters fails to be printed. These cannot be overcome only by improving the accuracy of the components and have offered a serious problem in ensuring the printing quality when considering the wear of the stain preventing members and the drum caused by their friction with the paper and the wear of the bearings or the like.

In view of such points, the present embodiment intends to maintain constant the distance between the stain preventing member and the character drum by a small magnitude of printing energy and permanently ensure a high printing quality. As shown in FIG. 1, the ink roller 1 is urged against the character drum 3, and the stain preventing member 2e shielding the characters at every other column is disposed between the character drum 3 and the paper P. The exposed columns of the drum 3 are printed, whereafter the drum is shifted by a column with the intermediate hammer holder 2 by the aforementioned shift mechanism to expose the remaining columns and effect printing thereon.

Figure 5A:
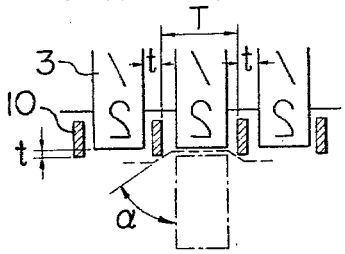
FIG. 5A PRIOR ART
FIG. 5A is a top plan view corresponding to FIG. 3.
Figure 5B:
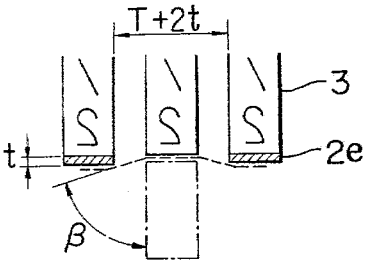
FIG. 5B is a similar view corresponding to the present inventive concept.
Figure 6A:
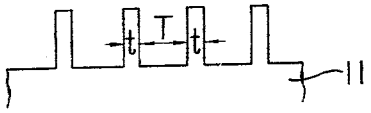
FIG. 6A PRIOR ART
FIGS. 6A and 6B are schematic views illustrating the comparative relationship of parts according to the prior art and the present invention, respectively.
Figure 6B:
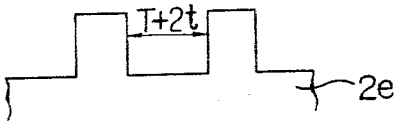

The stain preventing member 2e may be formed of a sheet of metal or plastics (thickness of 0.1 to 0.3 mm) and makes contact with the character drum 3 during the printing by its flexibility, thereby creating the condition in which the force for deflecting the paper P may be reduced. FIG. 5A is a top plan view corresponding to FIG. 3. Let T be the width of the paper bent at this time. In the case of FIG. 5B showing the present invention, the width of the paper can be widened to T+2t and accordingly, the angle at which the paper is bent can be widened from $\alpha$ to $\beta$, so that printing can be sufficiently effected even if the hammers are driven by a small magnitude of force. FIGS. 6A and 6B also show that the cut-away width is wider than that in FIG. 4. These effects are atributable to the fact that the place of the member 2e is set on the characters of the drum 3, thus achieving a combined use of places.

What we claim is:

1. A printing apparatus comprising:

a motor;

a character drum connected to said motor for rotation thereby and having a surface provided with columns each having characters thereon and supplied with ink;

a group of main hammers disposed opposite the drum surface;

means operatively connected to said motor for feeding printing paper between said group of main hammers and said drum surface, by the rotational force of the motor;

a group of intermediate hammers disposed between said group of main hammers and the character drum on a one hammer-to-two columns basis, said hammers disposed opposite alternate columns of characters;

stain preventing means disposed between said character drum and said paper, said stain preventing means having portions in said print line which overlie the alternate columns of characters on said character drum at positions between said hammers, whereby said stain preventing means shield the columns on said character drum adjacent a column bearing a character to be printed by actuation of an intermediate hammer; and means operatively connected to said motor for shifting integrally said group of intermediate hammers and said stain preventing means by one column to facilitate printing along a line at each column on printing paper adjacent said drum surface upon actuation of said group of main hammers.

2. A printing apparatus according to claim 1 further comprising:

means for operating said shifting means in response to the rotational force of said motor when said motor starts rotating, to set said group of intermediate hammers and said stain preventing member to initial positions thereof to start the printing of a line.

* * * * *

UNITED STATES PATENT AND TRADEMARK OFFICE

CERTIFICATE OF CORRECTION

PATENT NO. : 4,250,807

DATED : February 17, 1981

INVENTOR(S) : KONDO, ET AL.

It is certified that error appears in the above-identified patent and that said Letters Patent are hereby corrected as shown below:

On The Title Page:

[73] Assignees: Canon Kabushiki Kaisha; Denshi Kabushiki Kaisha, both of Tokyo, Japan should read:

[73] Assignees: Canon Kabushiki Kaisha; Canon Denshi Kabushiki Kaisha, both of Tokyo, Japan Signed and Sealed this

*Fourth* Day of *August 1981*

[SEAL]

*Attest:*

GERALD J. MOSSINGHOFF

*Attesting Officer*

*Commissioner of Patents and Trademarks*